US007467439B2

(12) United States Patent
Lijzenga et al.

(10) Patent No.: US 7,467,439 B2
(45) Date of Patent: Dec. 23, 2008

(54) SUCTION ATTACHMENT FOR A VACUUM CLEANER

(75) Inventors: Henk Lijzenga, Hoogeveen (NL); Alexander Poul Splinter, Hoogeveen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 484 days.

(21) Appl. No.: 10/539,352

(22) PCT Filed: Dec. 2, 2003

(86) PCT No.: PCT/IB03/05666

§ 371 (c)(1),
(2), (4) Date: Jun. 15, 2005

(87) PCT Pub. No.: WO2004/056252

PCT Pub. Date: Jul. 8, 2004

(65) Prior Publication Data

US 2006/0213026 A1 Sep. 28, 2006

(30) Foreign Application Priority Data

Dec. 19, 2002 (EP) ..... 02080395

(51) Int. Cl.

| | |
|---|---|
| ***A47L 5/00*** | (2006.01) |
| ***A47L 9/04*** | (2006.01) |
| ***A47L 9/06*** | (2006.01) |
| ***A47L 5/34*** | (2006.01) |
| ***A47L 9/02*** | (2006.01) |

(52) U.S. Cl. ..... 15/373; 15/355; 15/368; 15/415.1

(58) Field of Classification Search ..... 15/373, 15/355, 368, 415.1

See application file for complete search history.

(56) References Cited

U.S. PATENT DOCUMENTS

| | | | | |
|---|---|---|---|---|
| 3,821,831 | A * | 7/1974 | Grover | 15/339 |
| 4,638,526 | A * | 1/1987 | Murata et al. | 15/367 |
| 4,638,527 | A * | 1/1987 | Fleischhauer | 15/371 |
| 4,888,851 | A * | 12/1989 | Crouser et al. | 15/371 |
| 5,123,141 | A * | 6/1992 | Erickson et al. | 15/373 |
| 5,347,679 | A * | 9/1994 | Saunders et al. | 15/416 |
| 6,385,811 | B1 * | 5/2002 | Dilger et al. | 15/373 |
| 6,473,934 | B2 | 11/2002 | Lijzenga | |
| 2004/0000022 | A1 * | 1/2004 | Rukavina | 15/339 |

FOREIGN PATENT DOCUMENTS

| | | |
|---|---|---|
| DE | 10000504 | 7/2002 |
| EP | 0 158 145 B1 | 10/1984 |
| EP | 163772 | 12/1984 |

(Continued)

*Primary Examiner*—Joseph J. Hail, III
*Assistant Examiner*—Bryan R Muller

(57) ABSTRACT

A suction attachment has a suction nozzle and is coupled to a suction channel of a vacuum cleaner by a coupling member. The coupling member is pivotable relative to the suction nozzle about a pivot axis which extends perpendicularly to a main displacement direction of the attachment. The suction nozzle has front and rear brushes. The suction nozzle also has an adjustment mechanism for adjusting the two brushes between retracted and protruding positions relative to the bottom surface of the suction nozzle. The suction attachment further has a rolling member is arranged near the pivot axis. The pivot axis is arranged between the front brush and at least a portion of the rear brush.

10 Claims, 6 Drawing Sheets

FOREIGN PATENT DOCUMENTS

Figure 1:
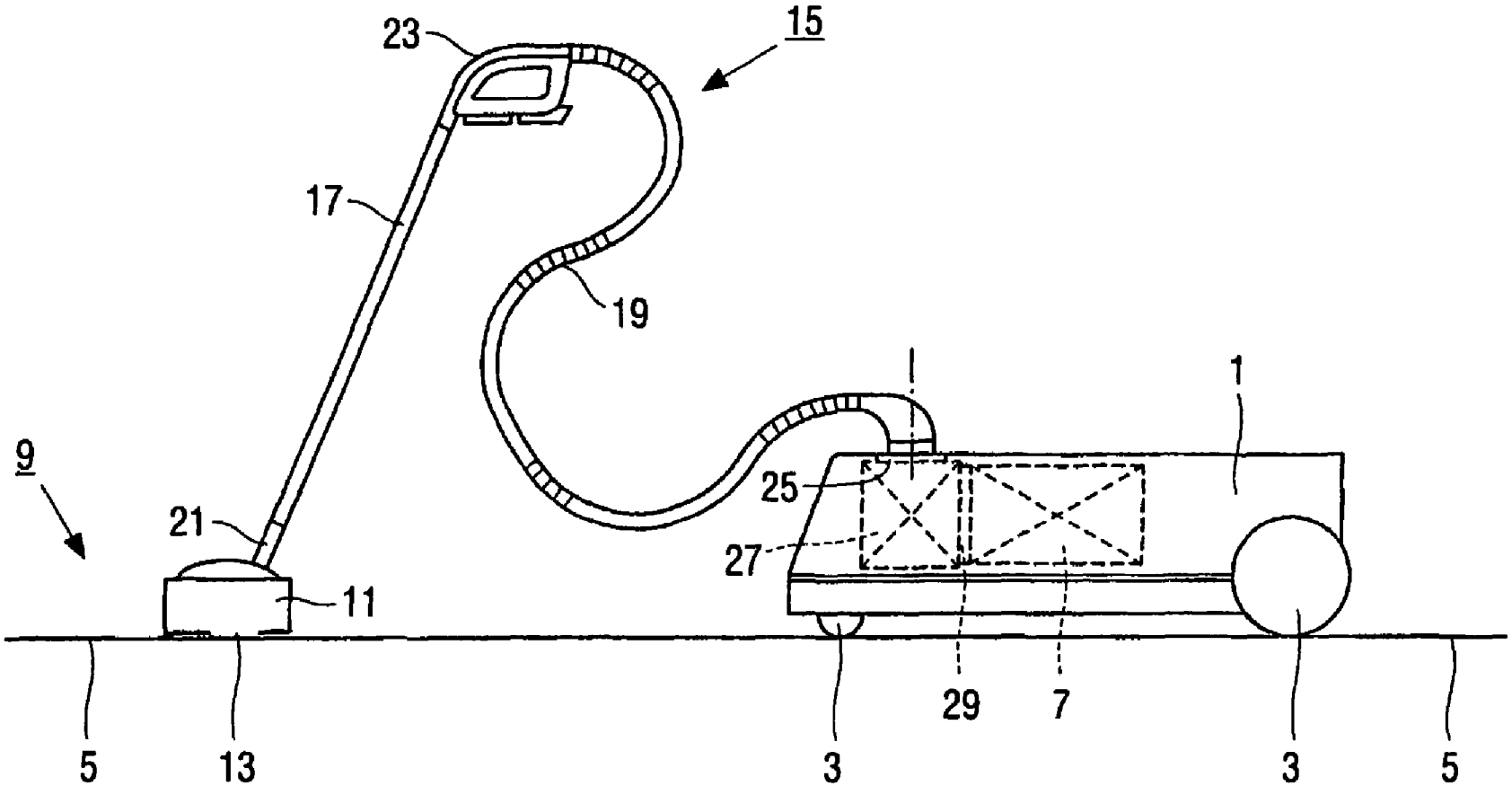

| | | |
|---|---|---|
| EP | 158145 | 3/1985 |
| EP | 0668045 | 2/1995 |
| FR | 2821540 | 9/2006 |
| GB | 2364499 | 1/2002 |
| WO | 9209231 | 6/1992 |
| WO | 0103565 | 1/2001 |

* cited by examiner

SUCTION ATTACHMENT FOR A VACUUM CLEANER

The invention relates to a suction attachment for a vacuum cleaner comprising a suction nozzle, a coupling member for coupling the suction attachment to a suction channel of the vacuum cleaner, said coupling member being pivotable relative to the suction nozzle about a pivot axis extending perpendicularly to a main displacement direction of the suction attachment, a first and a second brush extending near, respectively, a front edge and a rear edge of the suction nozzle, an adjustment mechanism for adjusting the first and the second brush from a first position, in which the first and the second brush are in a retracted position relative to a bottom surface of the suction nozzle, into a second position, in which the first and the second brush are in a protruding position relative to said bottom surface, and a rolling member arranged near said pivot axis in such a position that, during operation, said rolling member is in contact with a surface to be cleaned when the first and the second brush are in said first position, and said rolling member is not in contact with the surface to be cleaned when the first and the second brush are in said second position.

The invention further relates to a vacuum cleaner comprising a housing, an electrical suction unit accommodated in said housing, a suction channel, and a suction attachment of the kind mentioned in the opening paragraph which can be coupled to the suction unit via the suction channel.

A suction attachment and a vacuum cleaner of the kinds mentioned in the opening paragraphs are known from EP-B-0 158 145. The coupling member of the known suction attachment can be coupled to a suction tube of the known vacuum cleaner. The rolling member of the known suction attachment comprises a pair of castors which are mounted on a central portion of the suction nozzle just beneath the pivot axis of the coupling member. During operation a user of the vacuum cleaner exerts a force upon the suction tube in order to move the suction nozzle over the surface to be cleaned. The function of the castors is to provide a vertical supporting force which compensates a vertical downward component of said force exerted by the user, so that unwanted pivoting motions of the suction nozzle under the influence of said vertical component are limited. In the known suction attachment, the castors are in contact with the surface to be cleaned when the first and the second brush are in the first retracted position, i.e. when the suction attachment is used on a carpet, and the castors are not in contact with the surface to be cleaned when the first and the second brush are in the second protruding position, i.e. when the suction attachment is used on a hard floor. In this manner it is prevented that the castors adversely affect the manoeuvrability of the suction attachment on a hard floor, in particular when the castors are made from a soft elastically deformable material such as rubber. On hard floors the castors would in particular adversely affect the manoeuvrability of the suction attachment in directions transverse to the main displacement direction of the suction attachment.

A disadvantage of the known suction attachment and of the known vacuum cleaner is that the position of the suction nozzle on a hard floor, with the first and the second brush in the second protruding position, is not stable. In such a case the suction nozzle rests on the hard floor exclusively via the first and the second brush. When the user exerts a force on the suction tube to move the suction nozzle over the floor, the suction nozzle may pivot about the second brush under the influence of the vertical component of said force. As a result of said pivoting motion of the suction nozzle, the suction force of the suction nozzle decreases considerably. Also as a result of said pivoting motion of the suction nozzle, the castors may come into contact with the hard floor, so that the manoeuvrability of the suction attachment on the floor is adversely affected.

It is an object of the present invention to provide a suction attachment and a vacuum cleaner of the kinds mentioned in the opening paragraphs, in which the stability of the position of the suction nozzle on hard floors is improved, so that the above described disadvantages of the known suction attachment are prevented as much as possible.

In order to achieve said object a suction attachment in accordance with the invention is characterized in that, seen in the main displacement direction, said pivot axis is arranged between the first brush and at least a portion of the second brush.

In order to achieve said object a vacuum cleaner in accordance with the invention is characterized in that the suction attachment used therein is a suction attachment in accordance with the invention.

The invention is based on the insight that the force, which is exerted by the user to move the suction nozzle over the surface to be cleaned, is introduced into the suction nozzle at the location of the pivot axis about which the coupling member is pivotable relative to the suction nozzle. As a result of the fact that, in accordance with the invention, said pivot axis is arranged between the first brush and at least a portion of the second brush, the following effect is achieved on a hard floor, i.e. when the suction nozzle rests on said floor exclusively via the first and the second brush. A mechanical moment exerted on the suction nozzle about said portion of the second brush and associated with the vertical component of the user's force, which is introduced into the suction nozzle at the location of the pivot axis, is compensated by a mechanical moment exerted on the suction nozzle about said portion of the second brush and associated with vertical supporting forces provided by the first brush and by the remaining portion of the second brush, which is present between the first brush and the pivot axis. As a result a pivoting motion of the suction nozzle about said portion of the second brush under the influence of said vertical component of the user's force is prevented. Furthermore, a mechanical moment exerted on the suction nozzle about said remaining portion of the second brush and associated with the vertical component of the user's force is compensated by a mechanical moment exerted on the suction nozzle about said remaining portion of the second brush and associated with a vertical supporting force provided by said portion of the second brush. As a result a pivoting motion of the suction nozzle about said remaining portion of the second brush under the influence of said vertical component of the user's force is also prevented. Since in this manner pivoting motions of the suction nozzle about any portion of the second brush under the influence of the vertical component of the user's force are prevented, an improved stability of the position of the suction nozzle on a hard floor is achieved.

A particular embodiment of a suction attachment in accordance with the invention is characterized in that, seen in the main displacement direction, the suction nozzle has a mainly V-shaped rear edge along which the second brush extends, the pivot axis being arranged, seen in the main displacement direction, between the first brush and a first and a second extreme portion of the second brush. As a result of the fact that the rear edge is V-shaped, a structure is made possible in which the pivot axis is located outside the contours of the suction nozzle and in which, nevertheless, the pivot axis is arranged between the first brush and at least a portion of the second brush. Said portion of the second brush is formed by said extreme portions of the second brush, which are located behind the pivot axis, seen from the front edge, as a result of the fact that the rear edge is V-shaped. Said location of the pivot axis outside the contours of the suction nozzle is efficient and practical from a constructional point of view.

A particular embodiment of a suction attachment in accordance with the invention is characterized in that the rolling member has an axis of rotation which coincides with the pivot axis. As a result a single shaft can be used to pivot the coupling member and to journal the rolling member relative to the suction nozzle, so that a simple and practical structure is achieved.

A particular embodiment of a suction attachment in accordance with the invention is characterized in that the rolling member has a relatively hard, non-resilient rolling surface. Since in a suction attachment in accordance with the invention contact of the rolling member with a hard floor is prevented, the rolling member does not need to have a relatively soft, elastically deformable rolling surface in order to prevent a rattling noise caused by the contact between the rolling member and the hard floor. The relatively hard, non-resilient rolling surface improves the manoeuvrability of the suction attachment when cleaning a carpet, i.e. when the first and the second brush are in the first retracted position and the rolling member is in contact with the carpet. The hard and non-resilient rolling surface does not cause any unwanted noise as a result of the contact between the rolling member and the carpet.

A particular embodiment of a suction attachment in accordance with the invention is characterized in that the rolling member is provided on a central portion of the suction attachment, wherein the coupling member is pivotable relative to said central portion about the pivot axis, and wherein the suction nozzle is pivotable relative to said central portion about an additional pivot axis extending parallel to the pivot axis. As a result of the use of said additional pivot axis, the suction nozzle can pivot relative to said central portion independently of the angular position of the coupling member relative to the central portion. As a result, during operation, the suction nozzle is always held in a position as close as possible to the surface to be cleaned under the influence of the underpressure present in the suction nozzle.

A further embodiment of a suction attachment in accordance with the invention is characterized in that the suction attachment comprises a blocking mechanism which cooperates with the adjustment mechanism and which blocks the suction nozzle in a blocking position relative to the central portion when the first and the second brush are in the second position, said blocking position being such that, during operation, the rolling member is not in contact with the surface to be cleaned. As a result of said blocking mechanism it is prevented that, when the suction attachment is used on a hard floor and the first and the second brush are in the second protruding position, the rolling member can come into contact with the hard floor as a result of a pivoting motion of the central portion of the suction attachment relative to the suction nozzle about the additional pivot axis.

Figure 2:
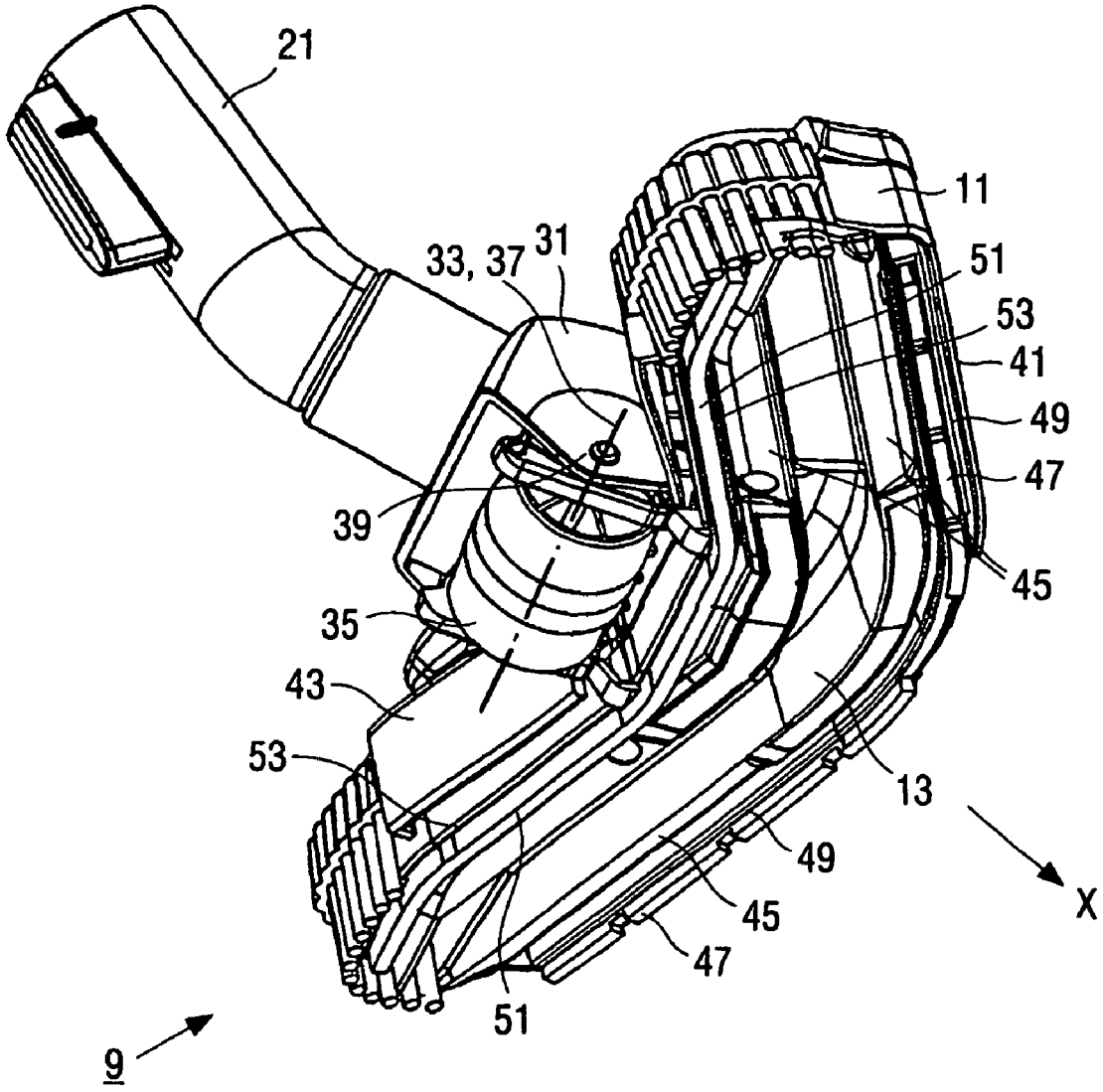
Figure 3:
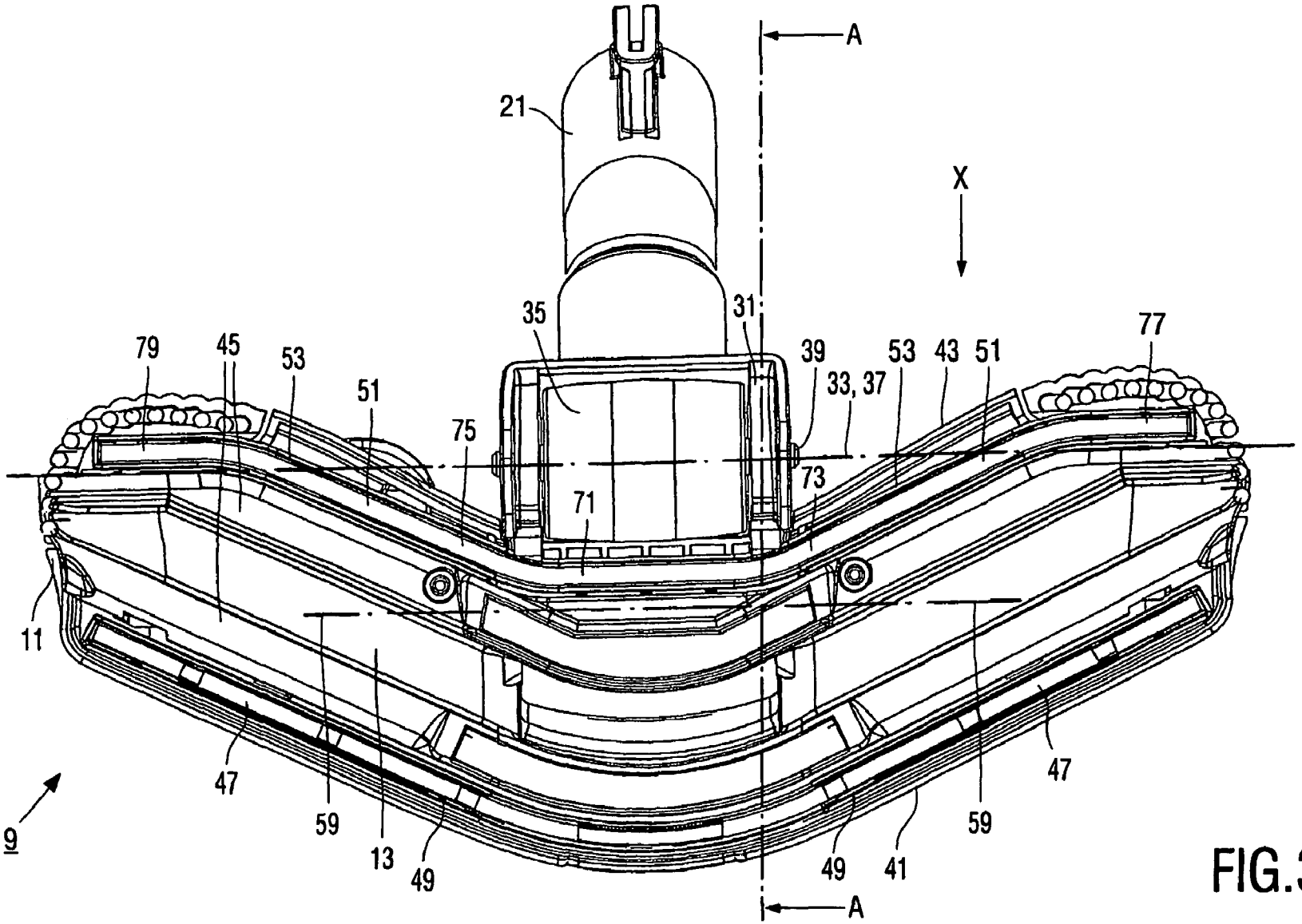
Figure 4:
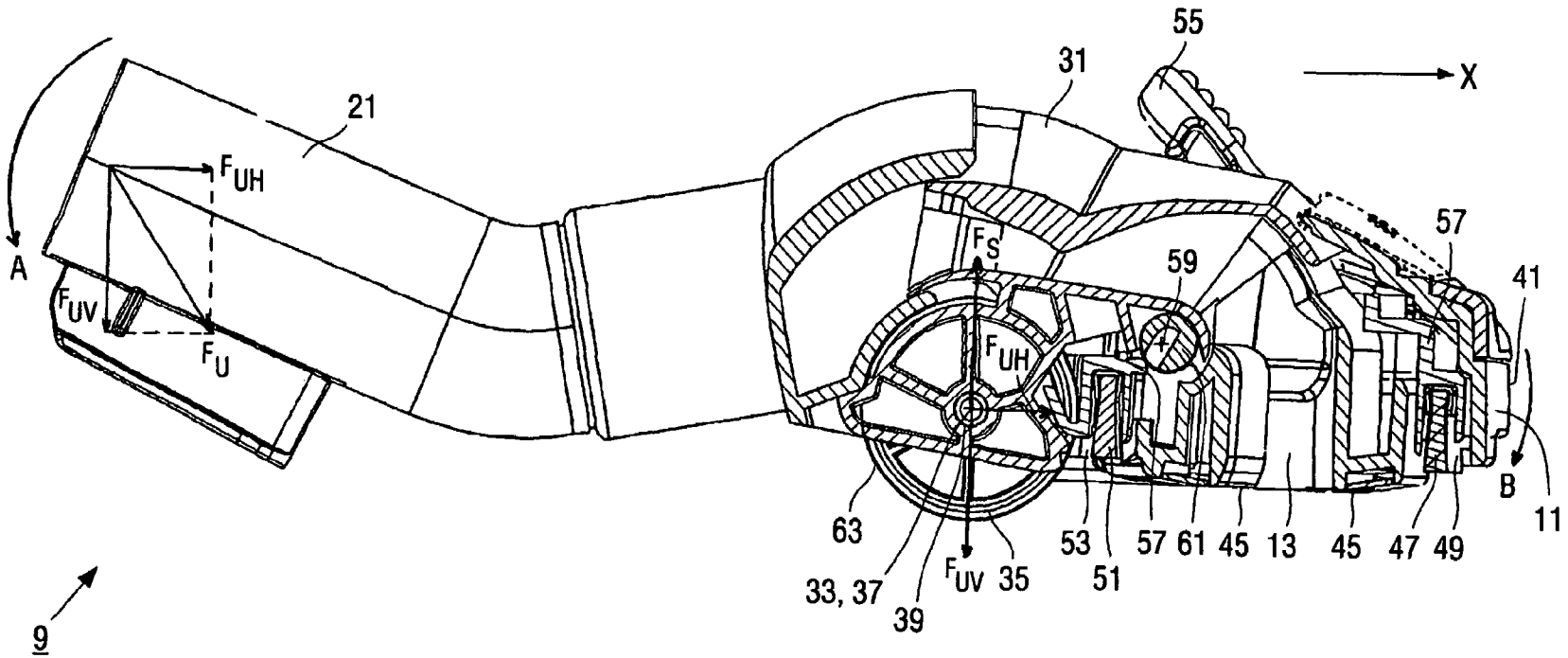
Figure 5:
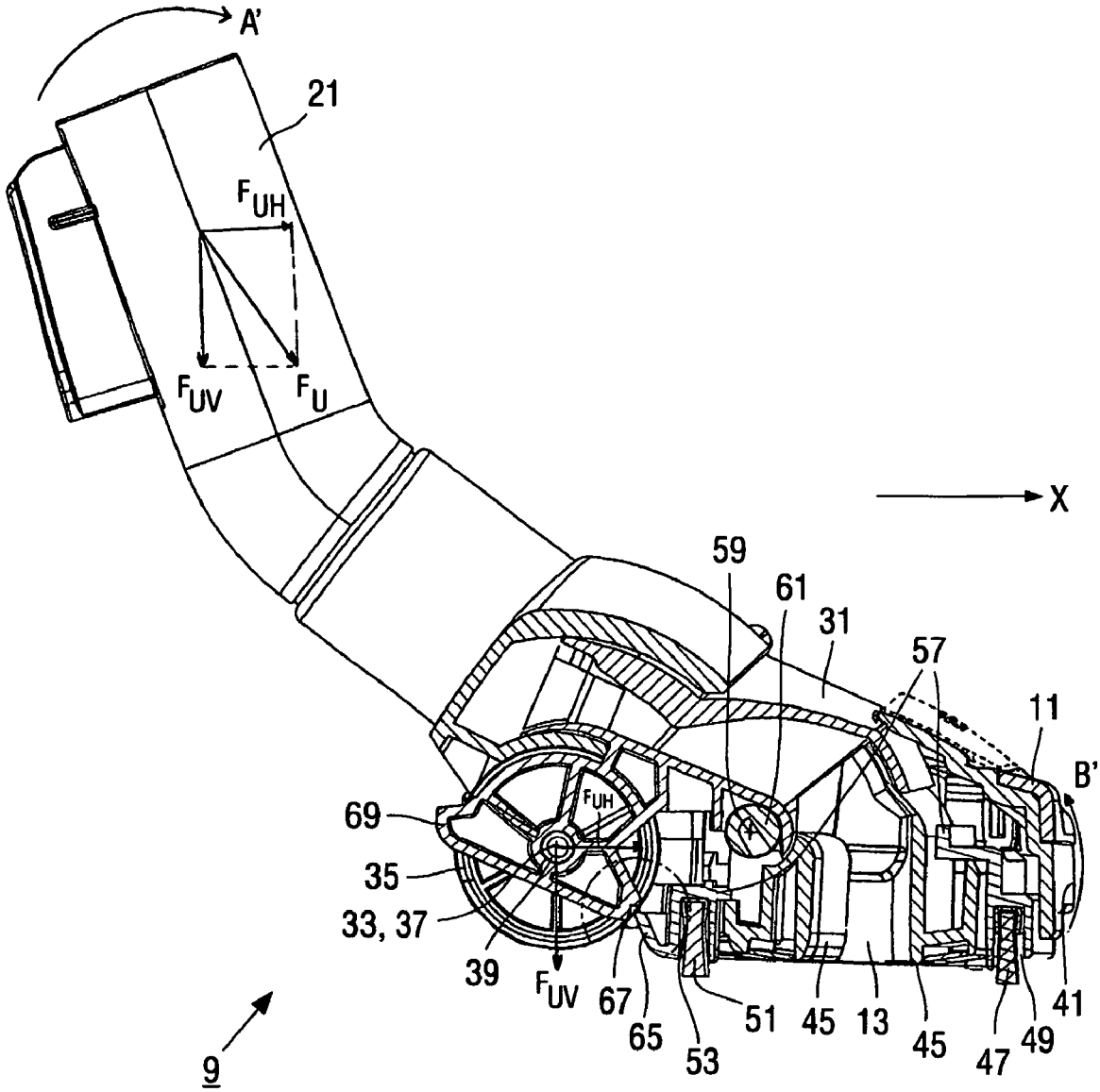
Figure 6:
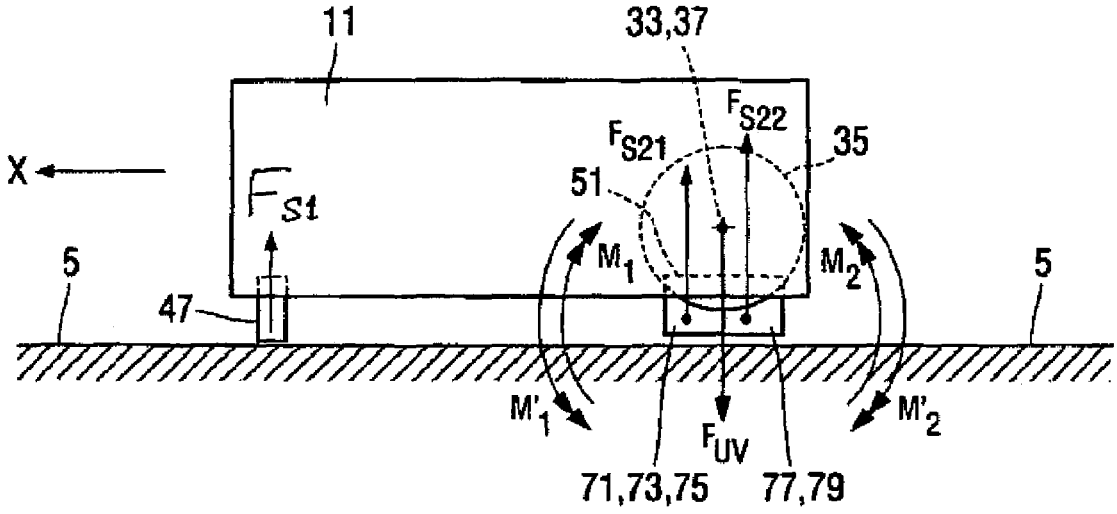

In the following embodiments of a suction attachment in accordance with the invention and of a vacuum cleaner in accordance with the invention will be described in detail with reference to the figures, in which FIG. 1 schematically shows a vacuum cleaner in accordance with the invention which is provided with a suction attachment in accordance with the invention, FIG. 2 shows in detail the suction attachment in accordance with the invention used in the vacuum cleaner of FIG. 1, FIG. 3 shows in detail a bottom view of the suction attachment of FIG. 2, FIG. 4 shows in detail a cross-section taken along the line A-A in FIG. 3, wherein a first and a second brush of the suction attachment are shown in a first retracted position, FIG. 5 shows in detail a cross-section taken along the line A-A in FIG. 3, wherein a first and a second brush of the suction attachment are shown in a second protruding position, and FIG. 6 schematically shows the supporting forces provided by the first and the second brush in the second protruding position shown in FIG. 5.

The vacuum cleaner in accordance with the invention, which is schematically shown in FIG. 1, is a so-called cylindrical or canister-type vacuum cleaner and comprises a housing 1 which can be displaced by means of wheels 3 over a surface 5 to be cleaned. The housing 1 accommodates an electrical suction unit 7 which is only schematically shown in FIG. 1. The vacuum cleaner further comprises a suction attachment 9 in accordance with the invention, which is only schematically shown in FIG. 1 and which comprises a suction nozzle 11 having a suction opening 13. The suction attachment 9 is releasably coupled to the housing 1 via a suction channel 15, which comprises a metal suction tube 17 and a flexible suction hose 19 in the embodiment shown. The suction attachment 9 comprises a coupling member 21 by means of which the suction attachment 9 is releasably coupled to the suction tube 17, while the suction tube 17 is releasably coupled to a tubular grip 23 attached to the suction hose 19. The suction hose 19 is releasably coupled to a suction input 25 of the housing 1. The suction input 25 opens into a dust chamber 27 of the housing 1, which is connected to the suction unit 7 via a filter 29.

The suction attachment 9 used in the vacuum cleaner of FIG. 1 is shown in detail in FIGS. 2, 3, 4 and 5, and the following description of the suction attachment 9 refers to all these Figures. The coupling member 21 is tubular and comprises coupling means, not shown in detail in FIGS. 2, 3, 4, 5, for coupling the suction attachment 9 to the suction tube 17. The coupling member 21 is pivotable relative to a central portion 31 of the suction attachment 9 about a pivot axis 33 which extends perpendicularly to a main displacement direction X in which the suction attachment 9 is mainly displaced over the surface 5 to be cleaned during operation. Accordingly the coupling member 21 is pivotable also relative to the suction nozzle 11. In FIG. 4 the coupling member 21 is shown in a lowermost pivoted position relative to the central portion 31, indicated by the arrow A, while in FIG. 5 the coupling member 21 is shown in an uppermost pivoted position relative to the central portion 31, indicated by the arrow A'. Said lowermost and said uppermost pivoted position are defined by suitable abutments which are not discussed in detail here. The central portion 31 comprises a rolling member 35 having an axis of rotation 37 which extends perpendicularly to the main displacement direction X. In the embodiment shown the axis of rotation 37 of the rolling member 35 coincides with the pivot axis 33 about which the coupling member 21 is pivotable relative to the central portion 31. This is realized by the use of a single shaft 39 to pivot the coupling member 21 and to journal the rolling member 35 relative to the central portion 31. In this way a simple and practical structure is achieved for said pivot axis 33 and for said axis of rotation 37.

As shown in FIGS. 2 and 3 the suction nozzle 11 is mainly V-shaped, seen in the main displacement direction X, the suction nozzle 11 having a mainly V-shaped front edge 41, a mainly V-shaped rear edge 43 and a mainly V-shaped suction opening 13 located in a bottom surface 45 of the suction nozzle 11 between said front edge 41 and said rear edge 43. Between the front edge 41 and the suction opening 13 a mainly V-shaped first brush 47 is present, which extends near and along the front edge 41 and is accommodated in a first mainly V-shaped recess 49 provided in the bottom surface 45 of the suction nozzle 11. Between the rear edge 43 and the suction opening 13 a mainly V-shaped second brush 51 is present, which extends near and along the rear edge 43 and is accommodated in a second mainly V-shaped recess 53 provided in the bottom surface 45 of the suction nozzle 11. The suction attachment 9 further comprises an adjustment mechanism by means of which the first and the second brush 47, 51 can be adjusted from a first position shown in FIG. 4, in which the first and the second brush 47, 51 are in a retracted position relative to the bottom surface 45 of the suction nozzle 11, into a second position shown in FIG. 5, in which the first and the second brush 47, 51 are in a protruding position relative to the bottom surface 45 of the suction nozzle 11. Said adjustment mechanism comprises an operating knob 55, which is provided at an upper side of the suction nozzle 11 and which co-operates with a displacement mechanism which is designed to displace a common carrier 57 of the first and the second brush 47, 51 when said operating knob 55 is switched by the user. The operating knob 55 and the common carrier 57 are shown in FIGS. 4 and 5, but said displacement mechanism will not be discussed in detail and may be of a kind commonly used in suction nozzles of vacuum cleaners.

The suction nozzle 11 is pivotable relative to the central portion 31 of the suction attachment 9 about an additional pivot axis 59 which extends parallel to the pivot axis 33 about which the coupling member 21 is pivotable relative to the central portion 31. In FIG. 4 the suction nozzle 11 is shown in a lowermost pivoted position in which the front edge 41 of the suction nozzle 11 is in a lowermost position relative to the central portion 31, indicated by the arrow B, while in FIG. 5 the suction nozzle 11 is shown in an uppermost pivoted position in which the front edge 41 of the suction nozzle 11 is in an uppermost position relative to the central portion 31, indicated by the arrow B'. Said lowermost and said uppermost pivoted position are defined by suitable abutments which are not discussed in detail here. In the embodiment shown the additional pivot axis 59 is provided by a shaft 61 extending perpendicularly to the main displacement direction X. Said shaft 61 belongs to the displacement mechanism of the adjustment mechanism for the first and the second brush 47, 51 described before, and has an additional journal relative to the central portion 31, not shown in the Figures, to provide the additional pivot axis 59. As a result of the additional pivot axis 59 the suction nozzle 11 can pivot relative to the central portion 31 independently of the angular position of the coupling member 21 relative to the central portion 31. As a result, during operation, the suction nozzle 11 is always held in a position as close as possible to and parallel to the surface 5 to be cleaned under the influence of the underpressure present in the suction opening 13. In this manner clearances between the suction nozzle 11 and the surface 5 to be cleaned, which adversely affect said underpressure and the suction power of the suction nozzle 11, are limited as much as possible.

If the suction attachment 9 is used to clean a carpet, the user has to adjust the first and the second brush 47, 51 to the first retracted position, shown in FIG. 4, by means of the operating knob 55. If the suction attachment 9 is used to clean a hard floor, the user has to adjust the first and the second brush 47, 51 to the second protruding position, shown in FIG. 5. During operation the user exerts a force $F_U$ on the suction tube in order to move the suction nozzle 11 over the surface 5 to be cleaned. The force $F_U$ is transmitted to the coupling member 21 and is introduced in the central portion 31 of the suction attachment 9 at the location of the pivot axis 33 about which the coupling member 21 is pivotable relative to the central portion 31. As shown in FIGS. 4 and 5, the force $F_U$ usually has a vertical downward component $F_{UV}$ and a horizontal component $F_{UH}$, which is directed in the main displacement direction X or in a direction opposite thereto dependent on the direction in which the user wants to move the suction nozzle 11. In the first retracted position of the first and the second brush 47, 51, shown in FIG. 4, the rolling member 35 is in contact with the surface 5 to be cleaned, i.e. the carpet. In this situation the rolling member 35 provides a vertical supporting force $F_S$ which partially or substantially completely compensates the vertical component $F_{UV}$ of the user's force. In this manner the vertical component $F_{UV}$ of the user's force cannot cause unwanted pivoting motions of the central portion 31 and of the suction nozzle 11 on the carpet, so that the rolling member 35 provides a stable position of the suction nozzle 11 on the carpet. In the embodiment shown the rolling member 35 has a relatively hard, non-resilient rolling surface 63, which is for example made from the same hard synthetic material as the housing of the suction attachment 9. The relatively hard, non-resilient rolling surface 63 improves the manoeuvrability of the suction attachment 9 on the carpet and does not cause any unwanted noise of the rolling member 35 when rolling over the carpet.

In the second protruding position of the first and the second brush 47, 51, shown in FIG. 5, the rolling member 35 is not in contact with the surface 5 to be cleaned, i.e. the hard floor. In this manner it is prevented that the rolling member 35 adversely affects the manoeuvrability of the suction attachment 9 on the hard floor. If contact between the rolling member 35 and a hard floor would be allowed, the rolling surface 63 of the rolling member 35 would have to be made from a relatively soft, resilient material such as rubber in order to prevent an unwanted rattling noise of the rolling member 35 when rolling over the hard floor. As a result the rolling member 35 would adversely effect the manoeuvrability of the suction attachment 9, because the soft resilient rolling surface 63 would provide a relatively high friction force between the rolling member 35 and the hard floor, which would hinder displacements of the suction attachment 9 in directions transverse to the main displacement direction X or would even make such transverse displacements impossible. In order to prevent that, in the second protruding position of the first and the second brush 47, 51, the rolling member 35 may contact the hard floor as a result of a pivoting motion of the central portion 31 relative to the suction nozzle 11 about the additional pivot axis 59, the suction attachment 9 comprises a blocking mechanism which cooperates with the adjustment mechanism of the first and the second brush 47, 51 and which blocks the suction nozzle 11 in a blocking position relative to the central portion 31 when the first and the second brush 47, 51 are in the second protruding position. As shown in FIG. 5 said blocking mechanism comprises a flange 65, which is provided on the common carrier 57 of the first and the second brush 47, 51 and which, in the second protruding position of the first and the second brush 47, 51, meshes with a recess 67 provided in a frame portion 69 of the central portion 31. As shown in FIG. 5, said blocking position corresponds with the uppermost pivoted position of the suction nozzle 11 relative to the central portion 31.

Consequently, on a hard floor the rolling member 35 does not provide a vertical supporting force on the suction nozzle 11. In order to prevent that, under the influence of the vertical component $F_{UV}$ of the user's force, the suction nozzle 11 will make unwanted pivoting motions about the second brush 51 extending near the rear edge 43 of the suction nozzle 11, the pivot axis 33, about which the coupling member 21 is pivotable relative to the central portion 31, is arranged between the first brush 47 and at least a portion of the second brush 51, seen in the main displacement direction X. As shown in FIG. 3 this is achieved in that the second brush 51 extends along the mainly V-shaped rear edge 43 of the suction nozzle 11, so that a central portion 71 of the second brush 51 and a first and a second obliquely oriented portion 73, 75 of the second brush 51 adjacent said central portion 71, together referred to as a first portion of the second brush 51 in the following, are arranged in front of the pivot axis 33 when seen from the first brush 47, and a first and a second extreme portion 77, 79 of the second brush 51, together referred to as a second portion of the second brush 51 in the following, are arranged behind the pivot axis 33 when seen from the first brush 47. Thus the pivot axis 33 is arranged, seen in the main displacement direction X, between the first brush 47 and said first and said second extreme portion 77, 79 of the second brush 51. In the embodiment shown said first and said second extreme portion 77, 79 of the second brush 51 extend perpendicularly to the main displacement direction X, but it is noted that said first and said second extreme portion 77, 79 may instead also be oriented obliquely relative to the main displacement direction X in line with the first and the second obliquely oriented portion 73, 75. As a result of the above described mainly V-shaped orientation of the rear edge 43 and the second brush 51, a structure is made possible in which the pivot axis 33 is located outside the contours of the suction nozzle 11 and in which, nevertheless, the pivot axis 33 is arranged between the first brush 47 and at least a portion of the second brush 51 to improve the stability of the position of the suction nozzle 11 on hard floors. A position of the pivot axis 33 outside the contours of the suction nozzle 11 is efficient and practical from a constructional point of view. Since the structure of the suction nozzle 11 does not need to be adapted in order to provide said pivot axis 33 thereon, the structure of the suction nozzle 11 can be fully optimized in order to achieve optimal suction performance.

Unwanted pivoting motions of the suction nozzle 11 about the second brush 51 under the influence of the vertical component $F_{UV}$ of the user's force are prevented as follows. FIG. 6 schematically shows the suction nozzle 11 on a hard floor 5 with the first and the second brush 47, 51 in the second protruding position. The vertical downward component $F_{UV}$ of the user's force is introduced into the suction nozzle 11 at the location of the pivot axis 33 which is situated, seen in the main displacement direction X, between the first brush 47 and the second portion 77, 79 of the second brush 51. The first brush 47 provides a vertical supporting force $F_{S1}$, while the first portion 71, 73, 75 of the second brush 51 provides a vertical supporting force $F_{S21}$ and the second portion 77, 79 of the second brush 51 provides a vertical supporting force $F_{S22}$. It is to be noted that in FIG. 6 the forces $F_{UV}$, $F_{S1}$, $F_{S21}$, $F_{S22}$ are only shown schematically and not in exact proportions. The vertical component $F_{UV}$ of the user's force and the supporting force $F_{S1}$ together exert a mechanical moment $M_1$ in clockwise direction on the suction nozzle 11 about the first portion 71, 73, 75 of the second brush 51. This mechanical moment $M_1$ is compensated by a compensating mechanical moment $M_1'$ in opposite direction, which is exerted on the suction nozzle 11 about the first portion 71, 73, 75 of the second brush 51 by the supporting force $F_{S22}$ provided by the second portion 77, 79 of the second brush 51. Likewise, the vertical component $F_{UV}$ of the user's force exerts a mechanical moment $M_2$ in anti-clockwise direction on the suction nozzle 11 about the second portion 77, 79 of the second brush 51. This mechanical moment $M_2$ is compensated by a compensating mechanical moment $M_2'$ in opposite direction, which is exerted on the suction nozzle 11 about the second portion 77, 79 of the second brush 51 by the supporting force $F_{S1}$ provided by the first brush 47 and by the supporting force $F_{S21}$ provided by the first portion 71, 73, 75 of the second brush 51. As a result pivoting motions of the suction nozzle 11 about both the first portion 71, 73, 75 of the second brush 51 and about the second portion 77, 79 of the second brush 51 under the influence of the vertical component $F_{UV}$ of the user's force are prevented, so that a stable position of the suction nozzle 11 on the hard floor 5 is achieved.

It is noted that the invention also includes embodiments in which an arrangement of the pivot axis between the first brush and at least a portion of the second brush is achieved by means of a different structure. The suction attachment may for example comprise a first and a second brush which are both straight and oriented perpendicularly to the main displacement direction. In such an embodiment the pivot axis may be arranged within the contours of the suction nozzle, so that the pivot axis is arranged between the first brush and the complete second brush.

In the suction attachment 9 described before the axis of rotation 37 of the rolling member 35 coincides with the pivot axis 33 about which the coupling member 21 is pivotable relative to the suction nozzle 11. The invention also includes embodiments in which the rolling member 35 is arranged in a different manner. However, in each embodiment of the invention the rolling member is arranged near, i.e. in the direct vicinity of said pivot axis. In this context the expression "near" should be interpreted in such a way that a distance present between the axis of rotation of the rolling member and the pivot axis is very small with respect to the main dimensions of the suction nozzle. In this manner it is achieved that, on a carpet, the vertical component of the user's force, which is introduced into the suction nozzle at the location of the pivot axis, is substantially directly transmitted to the surface to be cleaned via the rolling member without causing any substantial mechanical moment on the suction nozzle.

It is further noted that the invention also includes embodiments in which the suction nozzle is not pivotable relative to the portion of the suction attachment on which the rolling member is provided.

It is further noted that the invention also includes embodiments in which the coupling member, by means of which the suction attachment can be coupled to the suction channel of the vacuum cleaner, has a different structure or constitution. The coupling member may for example comprise a portion of the suction tube 17 or even the complete suction tube 17.

It is finally noted that the invention also includes so-called upright vacuum cleaners. In such an upright vacuum cleaner the suction attachment is, for example, pivotably coupled to a tubular support on which the housing accommodating the suction unit is mounted, or pivotably coupled to said housing directly.

The invention claimed is:

1. A suction attachment for a vacuum cleaner comprising:

a suction nozzle;

a coupling member for coupling the suction attachment to a suction channel of the vacuum cleaner, said coupling member being pivotable relative to the suction nozzle about a pivot axis extending substantially perpendicularly to a longitudinal axis of the coupling member;

a first brush and a second brush extending near, respectively, a front edge and a rear edge of the suction nozzle;

an adjustment mechanism for adjusting the first brush and the second brush from a first position, in which the first brush and the second brush are in a retracted position relative to a bottom surface of the suction nozzle, into a second position, in which the first brush and the second brush are in a protruding position relative to said bottom surface;

a rolling member configured for rolling and arranged near said pivot axis in such a position that, during operation, said rolling member extends below the first and second brush when the first and the second brush are in said first position, and said first and second brush extend below the rolling member when the first and the second brush are in said second position, wherein said pivot axis is arranged between the first brush and at least a portion of the second brush; and a blocking mechanism which cooperates with the adjustment mechanism and which blocks the suction nozzle in a blocked position relative to a central portion of the suction attachment when the first brush and the second brush are in the second position.

2. The suction attachment as claimed in claim 1, wherein the suction nozzle has a mainly V-shaped rear edge along which the second brush extends, the pivot axis being arranged, between the first brush and end portions of the second brush.

3. The suction attachment as claimed in claim 1, wherein the rolling member has an axis of rotation which coincides with the pivot axis.

4. The suction attachment as claimed in claim 1, wherein the rolling member has a relatively hard, non-resilient rolling surface.

5. The suction attachment as claimed in claim 1, wherein the rolling member is provided on a central portion of the suction attachment, wherein the coupling member is pivotable relative to said central portion about the pivot axis, and wherein the suction nozzle is pivotable relative to said central portion about an additional pivot axis extending parallel to the pivot axis.

6. A vacuum cleaner comprising:

a housing, an electrical suction unit accommodated in said housing, a suction channel, and a suction attachment configured to be coupled to the suction unit via the suction channel, wherein the suction attachment comprises:

a suction nozzle;

a coupling member for coupling the suction attachment to a suction channel of the vacuum cleaner, said coupling member being pivotable relative to the suction nozzle about a pivot axis extending substantially perpendicularly to a longitudinal axis of the coupling member;

a first brush and a second brush extending near, respectively, a front edge and a rear edge of the suction nozzle;

an adjustment mechanism for adjusting the first brush and the second brush from a first position, in which the first brush and the second brush are in a retracted position relative to a bottom surface of the suction nozzle, into a second position, in which the first brush and the second brush are in a protruding position relative to said bottom surface;

a rolling member configured for rolling and arranged near said pivot axis in such a position that, during operation, said rolling member extends below the first and second brush when the first and the second brush are in said first position, and said first and second brush extend below the rolling member when the first and the second brush are in said second position, wherein said pivot axis is arranged between the first brush and at least a portion of the second brush; and a blocking mechanism which cooperates with the adjustment mechanism and which blocks the suction nozzle in a blocking position relative to a central portion of the suction attachment when the first brush and the second brush are in the second position.

7. A suction attachment for a vacuum cleaner comprising:

a suction nozzle;

a suction channel connected to the suction nozzle by a coupler, the coupler being pivotable about a pivot axis;

a front brush extending near a front edge of the suction nozzle, and a rear brush extending near a rear edge of the suction nozzle, an adjustment mechanism for adjusting the front brush and the rear brush from a retracted position relative to a bottom surface of the suction nozzle in a first position to protruding position relative to the bottom surface in a second position;

a rolling member configured for rolling and arranged near said pivot axis in such a position that, during operation, said rolling member extends below the front brush and the rear brush when the front brush and the rear brush are in said first position, and the front brush and the rear brush extend below the rolling member when the front brush and the rear brush are in said second position, wherein said pivot axis is arranged between the front brush and at least a portion of the rear brush; and a blocking mechanism which cooperates with the adjustment mechanism and which blocks the suction nozzle in a blocked position relative to a central portion of the suction attachment when the front brush and the rear brush are in the second position.

8. The suction attachment of claim 7, wherein the rear edge is V-shaped having end portions, and wherein the pivot axis is arranged between the front brush and the end portions of the rear brush.

9. The suction attachment of claim 7, wherein the rolling member has an axis of rotation which coincides with the pivot axis.

10. The suction attachment of claim 7, wherein the rolling member is provided on the central portion of the suction attachment, the coupler being pivotable relative to the central portion about the pivot axis, and wherein the suction nozzle is pivotable relative to the central portion about an additional pivot axis extending parallel to the pivot axis.

* * * * *